US010206453B2

(12) United States Patent
Bohnsack et al.

(10) Patent No.: US 10,206,453 B2
(45) Date of Patent: Feb. 19, 2019

(54) FOOTWEAR INCLUDING A SUPPORT CAGE

(71) Applicant: Wolverine Outdoors, Inc., Rockford, MI (US)

(72) Inventors: Shaun Michael Bohnsack, Grand Rapids, MI (US); Lee Martin Smith, London (GB); Clark A. Matis, Durango, CO (US); John H. Burch, Belmont, MI (US)

(73) Assignee: Wolverine Outdoors, Inc., Rockford, MI (US)

( * ) Notice: Subject to any disclaimer, the term of this patent is extended or adjusted under 35 U.S.C. 154(b) by 88 days.

(21) Appl. No.: 15/425,600

(22) Filed: Feb. 6, 2017

(65) Prior Publication Data

US 2017/0231319 A1 Aug. 17, 2017

Related U.S. Application Data

(60) Provisional application No. 62/295,302, filed on Feb. 15, 2016, provisional application No. 62/294,556, filed on Feb. 12, 2016.

(51) Int. Cl.
*A43B 7/28* (2006.01)
*A43B 13/12* (2006.01)
(Continued)

(52) U.S. Cl.
CPC ..... *A43B 7/28* (2013.01); *A43B 13/04* (2013.01); *A43B 13/122* (2013.01);
(Continued)

(58) Field of Classification Search
CPC . A43B 13/122; A43B 13/125; A43B 23/0245; A43B 23/0275; A43B 23/22
(Continued)

(56) References Cited

U.S. PATENT DOCUMENTS 2,147,197 A * 2/1939 Glidden ..... A43B 1/02 36/3 A
4,130,947 A 12/1978 Denu
(Continued)

OTHER PUBLICATIONS

Nike Air Presto (prior art).
Li-Ning Prior Art Shoes (2011).

*Primary Examiner* — Ted Kavanaugh
(74) *Attorney, Agent, or Firm* — Warner Norcross + Judd LLP

(57) ABSTRACT

A footwear construction including a support cage that wraps an upper to provide an adaptive fit to accommodate a variety of foot shapes and to adapt to changes in foot shape during a gait cycle, while providing exceptional stability and support. The footwear can include an upper, a support cage and a sole assembly. The upper can be joined with the sole assembly and can include an exterior. The sole assembly can define a recess extending across a width of the sole assembly from a medial side to a lateral side. The support cage can be constructed from a semi-rigid but flexible polymeric material, disposed over the exterior of the upper and free floating relative to the exterior of the upper. The support cage can include a sole bridge that extends transverse to a longitudinal axis of the footwear, through the recess defined by the sole assembly.

17 Claims, 12 Drawing Sheets

(51) Int. Cl.
*A43B 13/04* (2006.01)
*A43B 13/22* (2006.01)
*A43B 23/02* (2006.01)
*A43B 23/22* (2006.01)

(52) U.S. Cl.
CPC ..... *A43B 13/125* (2013.01); *A43B 13/223* (2013.01); *A43B 23/0215* (2013.01); *A43B 23/0235* (2013.01); *A43B 23/0245* (2013.01); *A43B 23/0275* (2013.01); *A43B 23/22* (2013.01)

(58) Field of Classification Search
USPC ..... 36/50.1
See application file for complete search history.

(56) References Cited

U.S. PATENT DOCUMENTS 4,366,632 A 1/1983 Bente
4,461,288 A * 7/1984 Curtis ..... A43B 3/0073 602/23
4,476,639 A * 10/1984 Zaccaria ..... A43B 5/00 36/114
5,243,772 A 9/1993 Francis et al.
D374,117 S 10/1996 Fumy et al.
D376,471 S 12/1996 Kalin et al.
5,692,319 A * 12/1997 Parker ..... A43B 7/1495 36/114
6,199,303 B1 3/2001 Luthi et al.
6,301,806 B1 10/2001 Heller
6,421,937 B2 7/2002 Heller
6,477,791 B2 11/2002 Luthi et al.
6,499,235 B2 12/2002 Lussier et al.
6,528,140 B1 3/2003 Kalin et al.
6,715,218 B2 4/2004 Johnson
6,722,058 B2 4/2004 Lucas et al.
6,748,677 B2 6/2004 Briant et al.
6,782,642 B2 8/2004 Knoche et al.
6,807,753 B2 10/2004 Steszyn et al.
6,817,112 B2 11/2004 Berger et al.
6,920,705 B2 7/2005 Lucas et al.
6,931,765 B2 8/2005 Lucas et al.
6,954,998 B1 10/2005 Lussier
6,957,503 B2 10/2005 De Paoli
6,962,008 B2 11/2005 Manz et al.
6,983,553 B2 1/2006 Lussier et al.
6,983,557 B2 1/2006 Manz et al.
7,013,582 B2 3/2006 Lucas et al.
7,140,124 B2 11/2006 Manz et al.
7,181,869 B2 2/2007 Seydel et al.
7,188,439 B2 3/2007 DiBenedetto et al.
7,225,565 B2 6/2007 DiBenedetto et al.
7,328,527 B2 * 2/2008 Goldman ..... A43B 3/24 36/100
7,350,320 B2 4/2008 Chandler et al.
7,401,419 B2 7/2008 Lucas et al.
7,401,422 B1 7/2008 Scholz et al.
7,406,781 B2 8/2008 Scholz
7,441,349 B2 10/2008 Seydel et al.
7,481,009 B2 1/2009 De Paoli
7,487,602 B2 2/2009 Berger et al.
7,506,460 B2 3/2009 DiBenedetto et al.
7,596,891 B2 10/2009 Carnes et al.
7,631,382 B2 12/2009 DiBenedetto et al.
7,644,518 B2 1/2010 Chandler et al.
7,665,232 B2 2/2010 Manz et al.
7,676,960 B2 3/2010 DiBenedetto et al.
7,676,961 B2 3/2010 DiBenedetto et al.
7,716,852 B2 5/2010 Berger et al.
7,721,348 B2 5/2010 Nurnberg
7,730,637 B2 6/2010 Scholz
7,827,706 B2 11/2010 Briant et al.
7,918,811 B2 4/2011 Lussier et al.
7,980,009 B2 7/2011 Carnes et al.
8,001,704 B2 * 8/2011 Baudouin ..... A43B 7/1495 36/102
8,006,411 B2 8/2011 Manz et al.
8,056,268 B2 11/2011 DiBenedetto et al.
8,074,379 B2 * 12/2011 Robinson, Jr. ..... A43C 1/06 36/108
8,122,615 B2 2/2012 Lucas et al.
8,186,081 B2 5/2012 Wilson, III et al.
8,209,882 B2 7/2012 Leimer et al.
8,234,798 B2 8/2012 DiBenedetto et al.
8,327,559 B2 12/2012 Berger et al.
8,458,929 B2 6/2013 Carnes et al.
8,479,415 B2 * 7/2013 Berger ..... A43B 3/24 36/100
8,522,457 B2 9/2013 Scholz et al.
8,567,096 B2 10/2013 Scholz
8,584,378 B2 11/2013 Weidl et al.
8,696,520 B2 4/2014 Ellis et al.
9,032,647 B2 5/2015 Carnes et al.
9,087,159 B2 7/2015 Oleson et al.
9,220,318 B2 * 12/2015 James ..... A43B 11/00
9,591,890 B2 * 3/2017 Too-a-Foo ..... A43C 19/00
2002/0017036 A1 * 2/2002 Berger ..... A43B 7/08 36/3 B
2002/0174571 A1 11/2002 Briant et al.
2003/0208928 A1 11/2003 Steszyn et al.
2003/0208929 A1 11/2003 Lucas et al.
2004/0107606 A1 6/2004 De Paoli
2004/0148799 A1 8/2004 Lussier et al.
2004/0168352 A1 9/2004 Lucas et al.
2004/0177531 A1 9/2004 DiBenedetto et al.
2004/0221482 A1 11/2004 Berger et al.
2004/0221488 A1 11/2004 Seydel et al.
2005/0013513 A1 1/2005 Manz et al.
2005/0065270 A1 3/2005 Knoerr et al.
2005/0126042 A1 * 6/2005 Baier ..... A43B 7/18 36/50.1
2005/0166423 A1 8/2005 Norton
2005/0198868 A1 9/2005 Scholz
2006/0205303 A1 9/2006 Nurnberg
2006/0265905 A1 11/2006 Chandler et al.
2006/0283050 A1 12/2006 Carnes et al.
2006/0288612 A1 12/2006 Lucas et al.
2007/0011920 A1 1/2007 DiBenedetto et al.
2007/0022633 A1 2/2007 Seydel et al.
2007/0180736 A1 8/2007 DiBenedetto et al.
2007/0180737 A1 8/2007 DiBenedetto et al.
2008/0010854 A1 * 1/2008 Sokolowski ..... A43B 5/12 36/8.3
2008/0155859 A1 7/2008 Chandler et al.
2008/0263904 A1 10/2008 Scholz
2008/0271342 A1 11/2008 Lucas et al.
2009/0113762 A1 5/2009 Leimer et al.
2009/0265958 A1 10/2009 DiBenedetto et al.
2009/0313857 A1 12/2009 Carnes et al.
2010/0050478 A1 3/2010 DiBenedetto et al.
2010/0154258 A1 6/2010 Scholz et al.
2010/0292599 A1 11/2010 Oleson et al.
2011/0138652 A1 6/2011 Lucas et al.
2011/0197475 A1 8/2011 Weidl et al.
2011/0203142 A1 8/2011 Scholz
2011/0239488 A1 10/2011 Carnes et al.
2013/0173033 A1 7/2013 Oleson et al.
2013/0211563 A1 8/2013 Ellis et al.
2013/0247423 A1 9/2013 Carnes et al.
2014/0059896 A1 3/2014 Weidl et al.
2014/0100677 A1 4/2014 Ellis et al.
2015/0210034 A1 7/2015 Tarrier et al.
2016/0088901 A1 3/2016 Mahoney

* cited by examiner

FOOTWEAR INCLUDING A SUPPORT CAGE

BACKGROUND OF THE INVENTION

The present invention relates to footwear, and more particularly to an adaptive footwear construction including a support cage configured to wrap portions of an upper and provide enhanced stability.

Footwear is frequently designed to best address competing characteristics, for example, fit, stability, weight, protection and cushion. Many times, one characteristic is sacrificed for another, leaving the footwear less than ideal. For example, where stability to the wearer is paramount, a shoe might be built with extra structure to promote that stability. In turn, this can sacrifice fit, because the extra structure makes the footwear less adaptable to the many unique foot shapes of different wearers.

Further, where such stabilized footwear are constructed with multiple overlays or panels that are stitched together, these overlays, and the resultant footwear, are frequently difficult to shape to the large variety of compound curves and contours of certain feet, let alone many differently shaped feet. Thus, while the footwear provides structural stability to the wearer, the footwear frequently provides a less than satisfactory fit.

Another challenge to making well-fitted footwear is the fact that every foot, of every shape and size, changes its shape during a wearer's stride. If a shoe is inelastic, such as is the case with many structurally reinforced footwear, then the changing shape of the foot will not match the unitary shape of the interior of the footwear throughout the gait cycle. This can cause irritation, discomfort and in some cases can detrimentally alter the wearer's gait.

Thus, there remains room for improvement in the area of producing footwear that provides stability, adaptively fits multiple foot shapes and dynamically conforms to a wearer's moving foot.

SUMMARY OF THE INVENTION

A footwear construction is provided including a support cage that wraps at least a portion of an upper to provide an adaptive fit to accommodate a variety of foot shapes and to adapt to changes in foot shape during a gait cycle, while providing exceptional stability and support.

In one embodiment, the footwear can include an upper, a support cage and a sole assembly. The upper can be joined with the sole assembly and can include an exterior. The sole assembly can define a recess extending across a width of the sole assembly from a medial side to a lateral side. The support cage can be constructed from a semi-rigid but flexible polymeric material, disposed over the exterior of the upper, and free floating relative to the exterior of the upper. The support cage can include a sole bridge that extends transverse to a longitudinal axis of the footwear, through the recess defined by the sole assembly.

In another embodiment, the sole bridge can form a protective plate having a thickness. The protective plate can span forwardly through an arch region of the footwear and toward a forefoot region of the footwear. Optionally, the protective plate can span through a substantial portion of the forefoot region and/or can act as a shank in the footwear.

In still another embodiment, the sole assembly can include a midsole and an outsole. One or more of the outsole and the midsole can define a recess extending transverse to a longitudinal axis of the footwear, from a medial side of the footwear to a lateral side of the footwear. The sole bridge can be disposed in and/or can extend through the recess.

In yet another embodiment, the midsole can include a midsole exterior lateral side and a midsole exterior medial side. The support cage can extend downward beside the midsole exterior lateral side and downward beside the midsole exterior medial side on the respective lateral and medial sides.

In even another embodiment, the support cage can include a heel support that extends from lateral and medial sides of the support cage, rearward and around a heel of the footwear. Optionally, the heel support can be integrally formed with the support cage and can be free floating relative to underlying portions of the upper to provide a dynamic fit and yet a stability structure around the heel.

In a further embodiment, the support cage can include a lower heel band joined with the sole bridge. The lower heel band can extend rearwardly under the heel of a wearer of the footwear. The lower heel band can transition upward toward, and can be joined with, the heel support.

The current embodiments provide footwear that can adaptively fit a variety of foot shapes and can accommodate changes in foot shape during a wearer's gait cycle. The support cage can be semi-rigid, yet flexible to impart stability to the footwear, yet the support cage can float relative to the upper, allowing the dynamic conformance and reconfiguration to multiple foot contours and shapes, even during a gait cycle. Where the support cage includes the sole bridge forming a protective plate, underfoot protection can be provided via the footwear. The current embodiments also provide footwear having lightweight support and an adaptive fit. In addition, the footwear can be easily constructed, typically eliminating stitched overlays to create structure, and thereby potentially reducing manufacturing time and costs.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
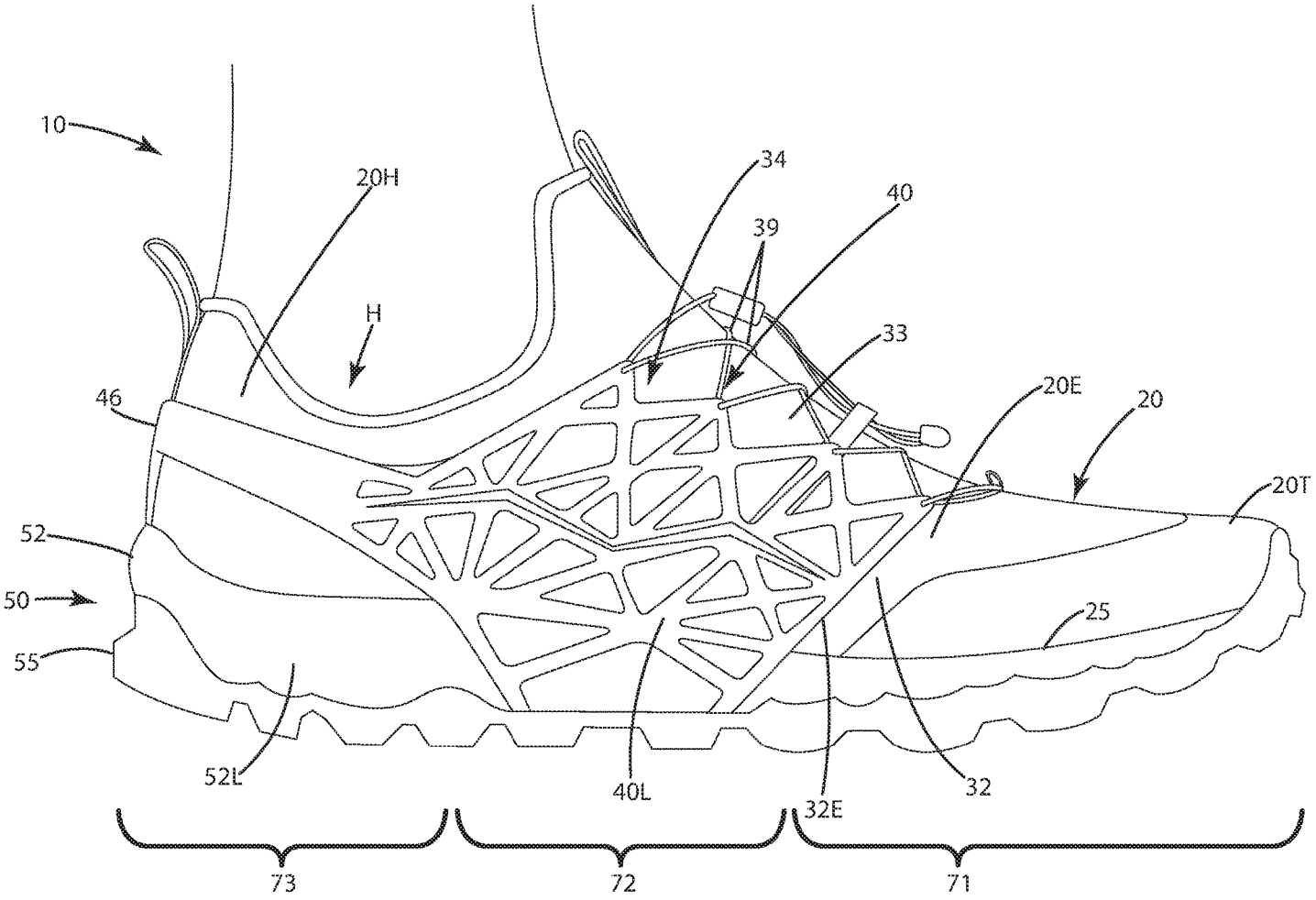
FIG. 1 is a side view of footwear including a support cage and upper in accordance with a current embodiment.

An article of footwear in accordance with a current embodiment is shown in FIGS. 1-8 and generally designated 10. The footwear includes an upper 20 over which a support cage 40 is at least partially free floated. The upper is joined with a sole assembly 50 having a midsole 52 and outsole 55. The upper 20 optionally is of a Strobel construction in which the foot receiving upper interior 21 is closed on its bottom or lowermost portion by a Strobel board an insole board, sock or liner 23 or other similar component. The footwear 10 can include a footbed and/or insole 22 disposed in the interior 21 of the upper 10. In this configuration, the footbed and/or insole can be disposed above the midsole, above the outsole, and optionally above a Strobel board where included.

Figure 2:
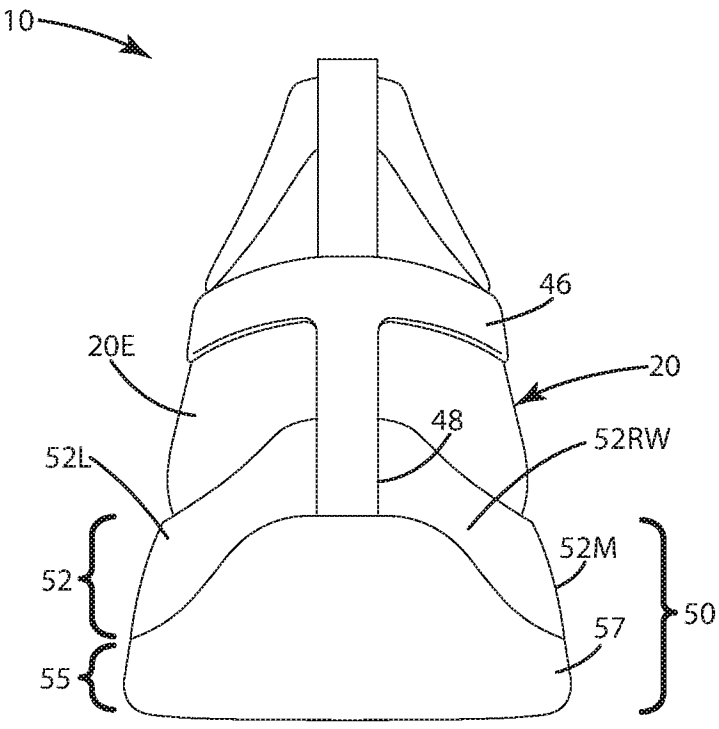
FIG. 2 is a rear view of the footwear.
Figure 6:
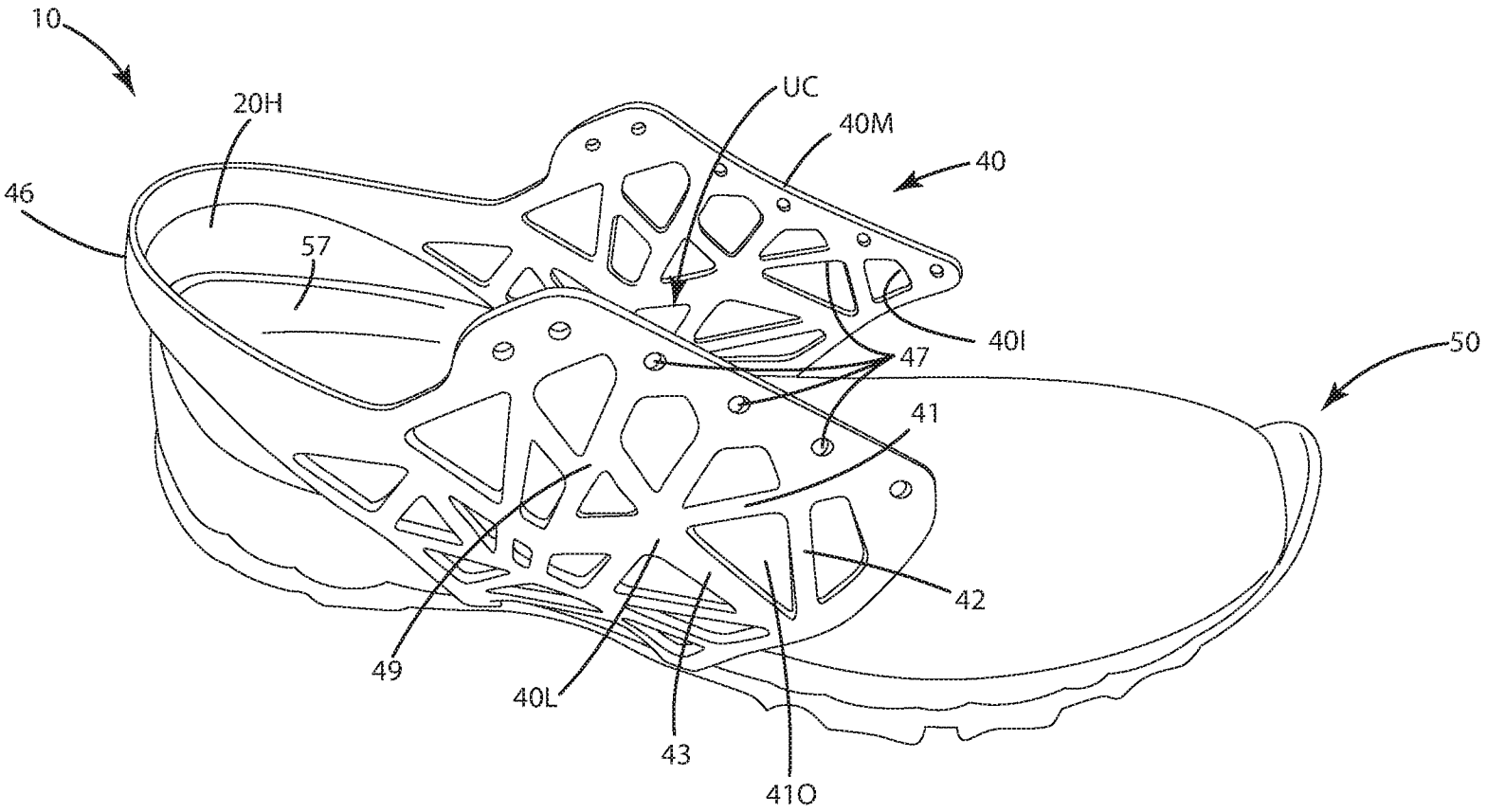
FIG. 6 is a perspective view of the support cage joined with a sole assembly before installation of an upper.
Figure 7:
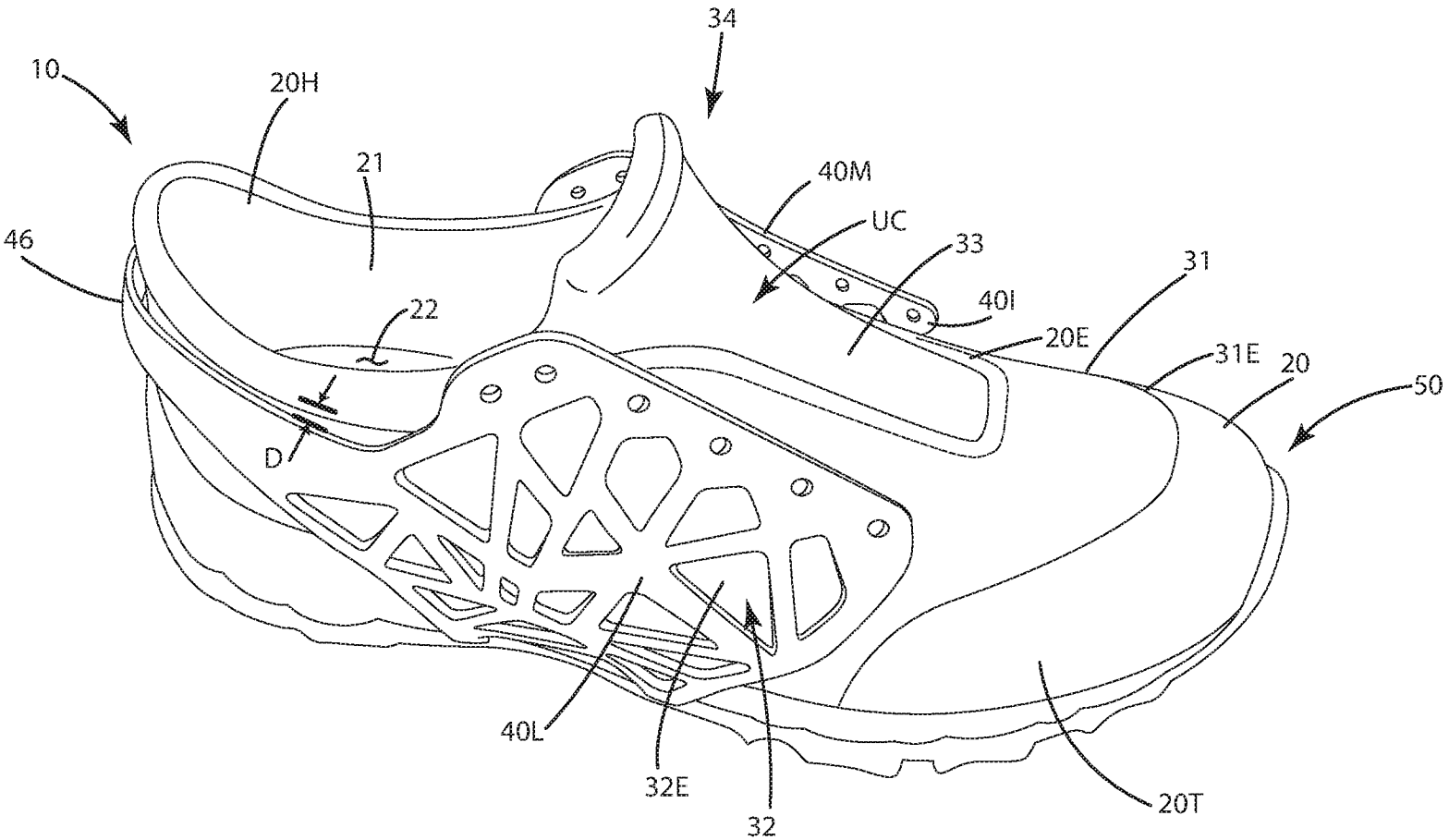
FIG. 7 is a perspective view of the support cage joined with the sole assembly after installation of an upper having a Strobel construction.
Figure 8:
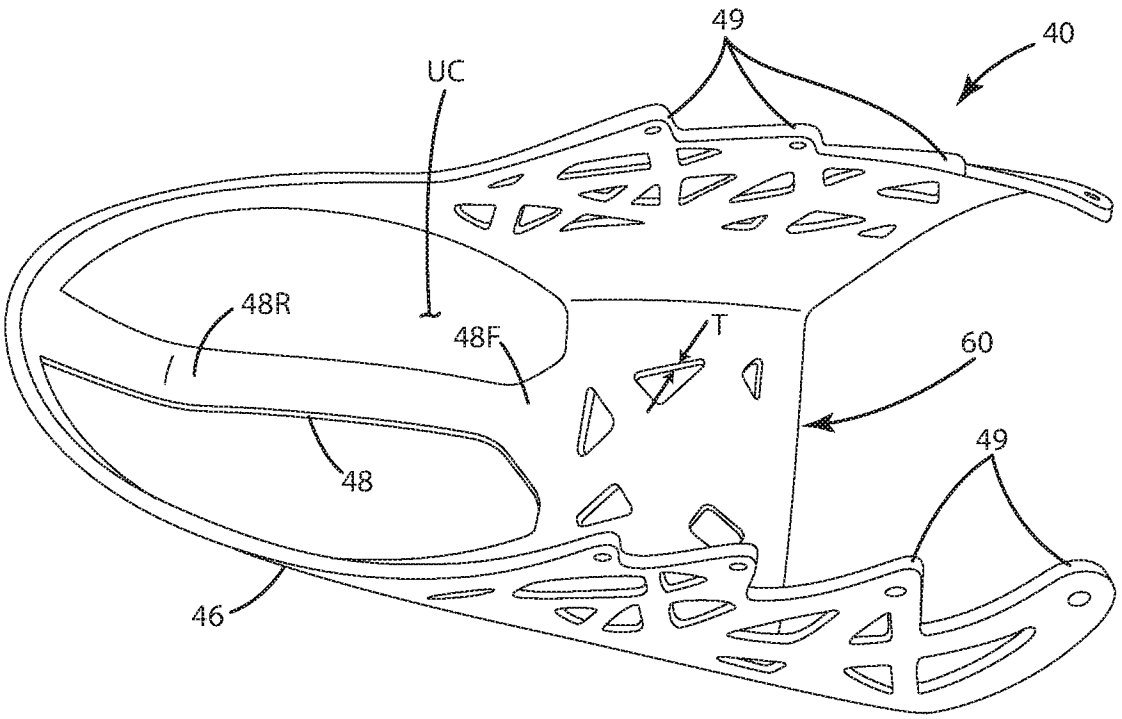
FIG. 8 is a perspective view of the support cage before installation relative to a sole assembly.

As illustrated in FIGS. 1-2 and 7, the support cage 40 at least partially or fully free floats over an upper 20 and an optional midsole 52 and outsole 55, which can collectively and/or individually form a sole assembly 50. As shown in FIGS. 1, 6 and 8, the support cage 40 can be constructed as a semi-rigid and flexible unit, optionally from a unitary, solid polymeric material, such as a thermoplastic polymer, polyurethane, high or low density polyethylene, a knitted or weaved material, and/or combinations thereof. The support cage 40 can include an interior surface 40I adapted to contact and/or engage at least a portion of the upper 20, and in particular its exterior surface 20E. The support cage 40 can include a sole bridge 60 extending from a lower portion thereof. The sole bridge 60 can span a width W of the footwear 10, from a medial side M to a lateral side L, transverse to the longitudinal axis LA, and optionally perpendicular thereto.

Optionally, the support cage 40 can be disposed a preselected distance D from the exterior surface of the upper 20. This distance can be about 0.01 mm to about 1 mm, or other distances depending on the particular application and the tightness of the support cage 40 as it is secured over the upper 20 when a wearer dons the footwear 10. This distance also can vary along the length of a support cage extending generally from the sole assembly toward the lacing system, which can be laced through certain portions of the support cage 40 as described in further detail below.

Figure 3:
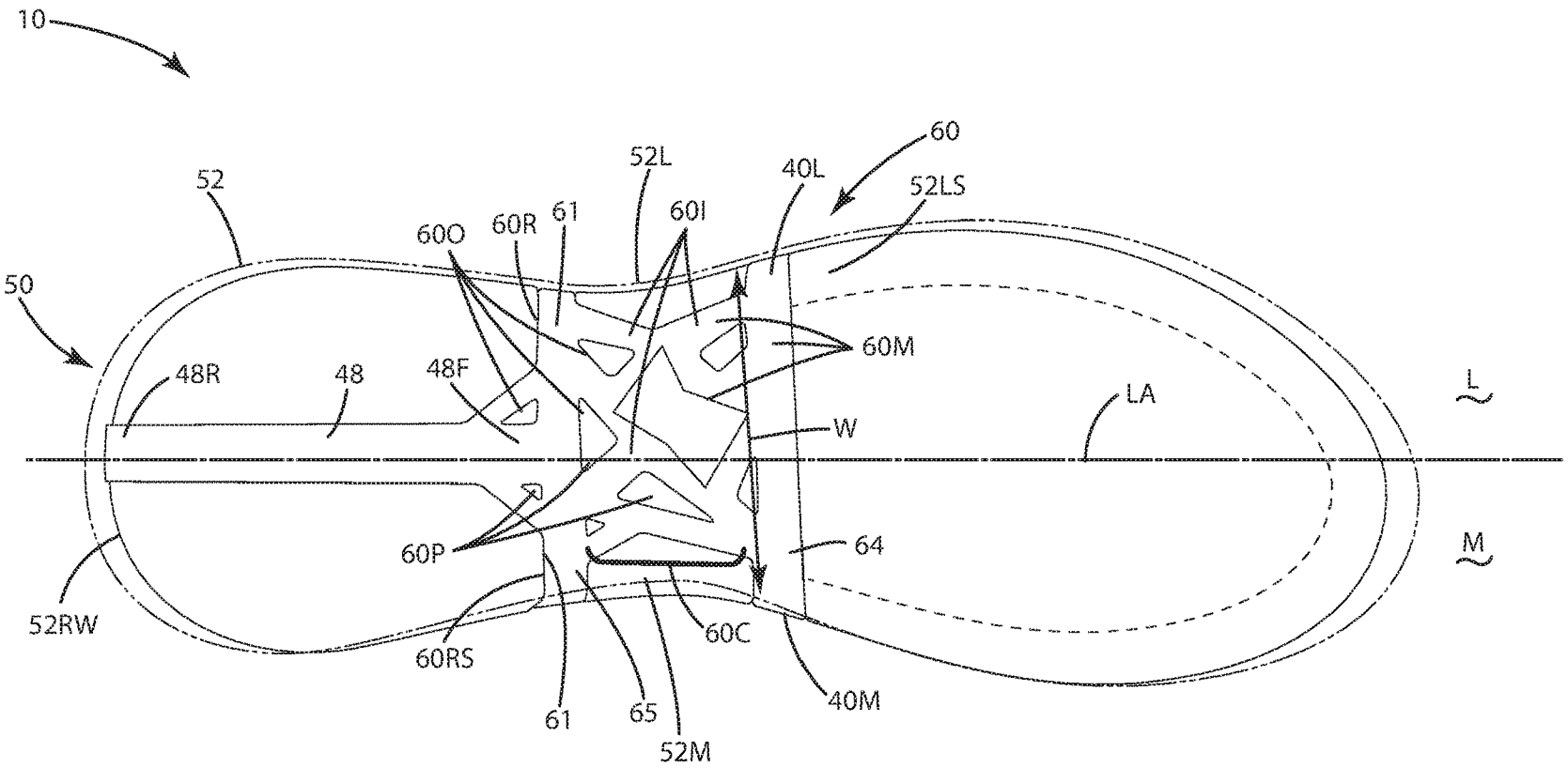
FIG. 3 is a bottom view of a midsole of the footwear defining a recess in which a sole bridge and heel support of the support cage are disposed.

The sole assembly 50 can be configured to accommodate the sole bridge 60. Rather than the sole bridge being located between the upper 20 and the sole assembly 50, or generally above the sole assembly 50, the sole bridge 60 can extend through the sole assembly. The sole assembly 50 can define a recess 60R that extends laterally across the width W of the footwear 10. The sole bridge 60 can be disposed in this recess 60R and can be freely and slidably mounted in it, or it can be fixedly mounted therein with adhesives or other structural features. The support cage 40 optionally can include a heel band 46 that can extend rearward and around the heel H of a wearer of the footwear. The support cage 40 further optionally can include a heal band 48 that extends rearward from the sole bridge 60 under the heel of the wearer. This heel band can transition upward to and can be joined with the heel support as further explained later. As illustrated in FIG. 3, the footwear can define a longitudinal axis LA. This longitudinal axis can separate the footwear into the lateral side L and the medial side M, which are generally disposed across one another across the longitudinal axis.

Although the current embodiments are illustrated in the context of a performance hiking shoe, they may be incorporated into any type or style of footwear, including athletic shoes, running shoes, trail shoes and boots, all-terrain shoes, barefoot running shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe generally between toe and heel, and the term "lateral direction" refers to a direction generally extending across the width of the shoe between the medial and lateral sides of the shoe. The use of directional terms should not be interpreted to limit the invention to any specific orientation.

Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot 71, arch or midfoot 72 and heel 73 regions are generally identified in FIG. 1, however, it is to be understood that delineation of these regions may vary depending upon the configuration of the sole assembly and footwear.

For purposes of disclosure, the embodiments herein are described in connection with footwear in the form of a hiking or performance shoe 10 having an upper 20, which as mentioned above, optionally can include a Strobel construction. Of course, support cage 40 and sole assembly 50 herein can be combined with any other type or style of upper construction capable of being suitably joined with the same. The joining of the sole assembly and the upper can be accomplished using adhesives, cement, injection molding, pour molding or any other technique used to join an upper and sole. As illustrated, the Strobel or insole board 23 can rest or be placed immediately adjacent the midsole upper surface 52U if optionally included in the construction.

With reference to FIGS. 1 and 3-5, the sole assembly 50 can be of a two-piece construction as mentioned above, generally including the midsole 52 and outsole 55. The midsole 52 can be constructed from a material having a first density that is generally less dense than the density of the material from which the outsole 55 is constructed. The first density of the midsole 52 can be such that it compresses relatively easily to provide cushion to the wearer's foot. The midsole can be constructed from ethyl vinyl acetate (EVA), polyurethane, latex, foam, a gel or other materials.

The midsole 22 can include an upper surface 52U and an opposing lower surface 52L. The upper surface 52U can be joined with the bottom of the upper 20 for example, a Strobel board 23, or other bottom closure of the upper 20. The upper surface 52U can be contoured to closely follow the natural contours of the bottom of a wearer's foot. For example, in the heel region 73, the midsole 52 can include a heel cup that generally extends upwardly around and receives a wearer's heel H therein when the footwear is worn by a wearer. The heel cup can offer some reinforcing support to the upper in the heel region, and generally prevent lateral or medial rolling of the heel.

Figure 4:
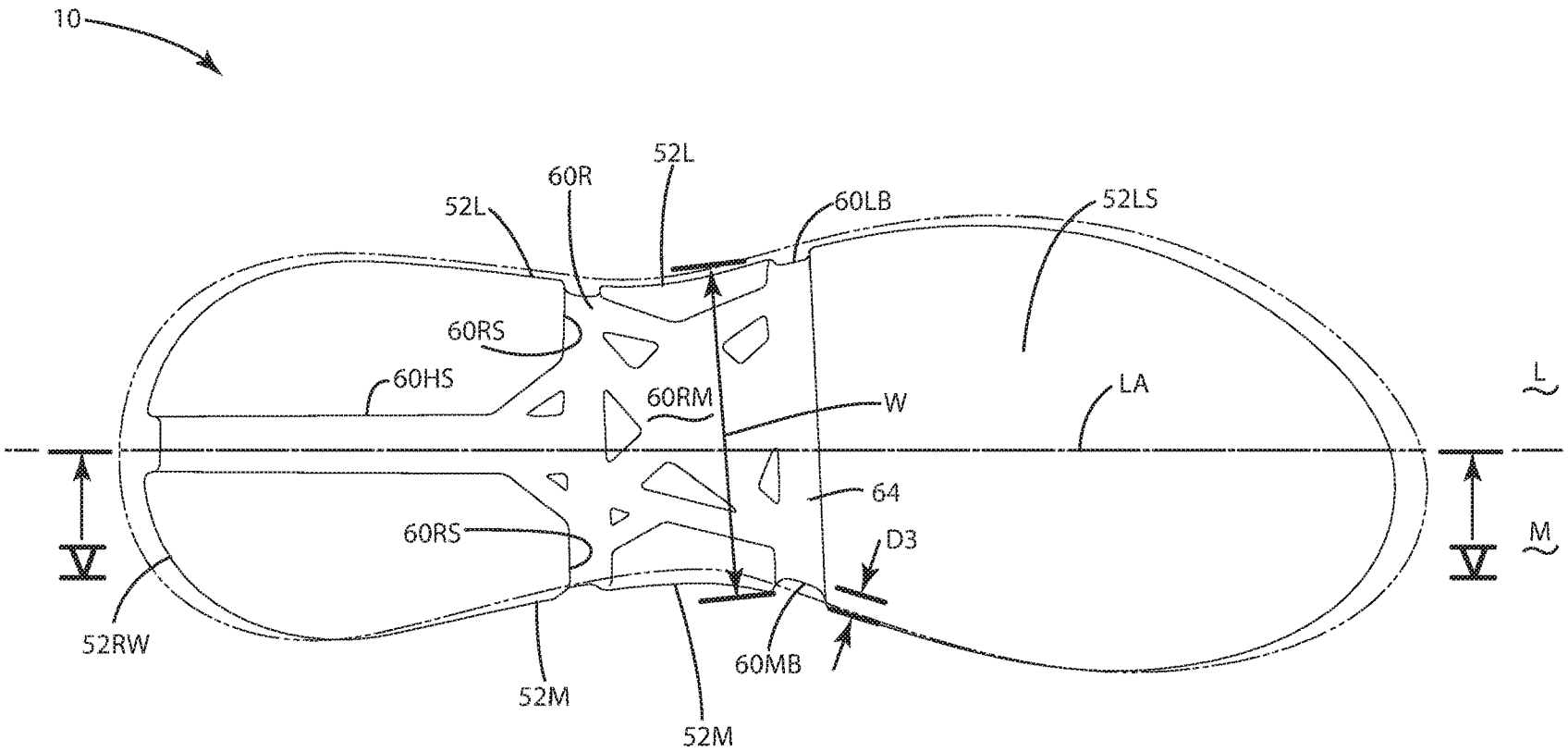
FIG. 4 is a bottom view of the midsole illustrating the recess without the portions of the support cage disposed therein.
Figure 5:
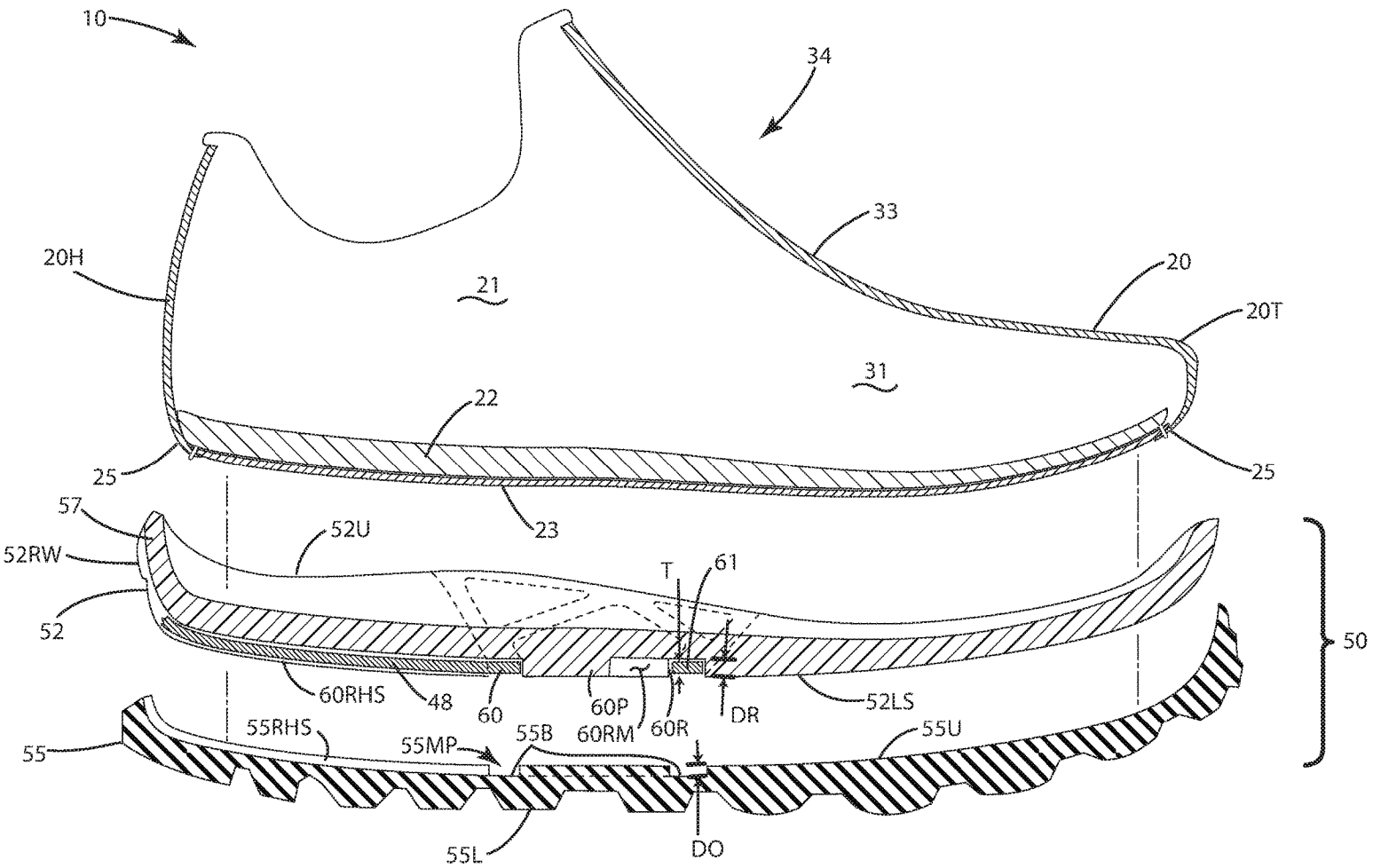
FIG. 5 is a section view of the sole assembly illustrating the recess taken along lines 5-5 in FIG. 4.

The midsole 52 can be configured to interface with the sole bridge 60. For example, as shown in FIGS. 3-5, the midsole 50 can define the recess 60R within which the sole bridge 60 is disposed. This recess 60R can be in the form of an opening, hole or other aperture that extends laterally across the sole assembly from the lateral side L to the medial side M, through at least apportion of the sole assembly. The recess 60R can be formed in the lower surface 52LS of the midsole 52. For example, the recess can be in the form of a channel or groove defined in the lower surface 52LS, optionally with the channel or groove bounded on all sides by the midsole and/or outsole, as opposed to being an open C-shaped or U-shaped channel or groove. The recess 60R can include a depth DR, which can be greater than or equal to the thickness T of the sole bridge when the sole bridge is disposed substantially entirely within the recess, as shown in FIG. 5.

Optionally, the outsole can define one or more outsole recesses 55R, as shown in FIG. 5. The combined depths of recesses DR and DO of the respective midsole and outsole can be greater than or equal to the thickness T of the sole bridge. In such a case, the depth DR and the depth DO each can be less than the thickness T of the sole bridge. As an example, the thickness T of the sole bridge can be optionally 1 mm to 10 mm, further optionally 2 mm to 8 mm, and further optionally 3 mm to 5 mm. The depth DR can be optionally less than these amounts, for example 1 mm to 5 mm. The depth DO can be a correspondingly similar dimension of 1 mm to 5 mm.

With regard to the recess 60R, it can have a variety of locations, configurations, and optional branches. For example, as shown in FIG. 4, the recess can span across and under the midfoot of the footwear, generally in the arch region 72. If desired, the recess can be fully formed substantially only in the arch region without extending into the forefoot region or the heel region. In other cases, the recess 60R can extend forward into the forefoot region 71 of the footwear. Optionally, the recess 60R can extend substantially into the forefoot region 71, all the way to the top 52U of the midsole, as indicated in broken lines in FIG. 5. With this elongated recess, the sole bridge also can extend into that region in the recess. In other cases, the recess 60R also can extend rearward from the arch region 72, into the heel region 73. For example, where the support cage 40 includes a rearward extending heel support 48, the recess 60R can include a heel support recess 60RHS, which extends rearward from the main portion 60RM of the recess 60R. This heel support recess 60RHS can be generally linear, extending along and/or parallel to the longitudinal axis LA from the main portion 60RM. The recess 60RHS can further extend under the heel H of the wearer toward the rear wall 52RW of the midsole 52. In some constructions, the recess 60RHS can also extend upward along and can be defined by the rear wall 52RW of the midsole. In this manner, the heel support can be partially protected within that part of the recess in the rear wall. This can reduce wear and/or damage to the heel support in this area.

As shown in FIGS. 1, 3 and 4, the midsole 52 can include a midsole exterior lateral wall 52L and a midsole exterior or medial wall 52M, disposed on the roof of the lateral L and medial M side of the longitudinal end LA. These walls can be contiguous with the rear wall 52RW of the midsole. Optionally, one or more of the midsole exterior lateral or medial walls can be configured to interface with a portion of the support cage. For example, the support cage 40 can include lateral and medial cage elements 40L and 40M on the respective lateral L and medial M sides of the footwear. One or both of these cage elements can extend downward along the midsole exterior lateral 52L and exterior medial 52M walls respectively. Portions of the lateral and medial cage elements also can be at least partially disposed in portions of the recess 60R to further secure the sole bridge and its respective components in place.

Further optionally, the outer surface of the respective lateral and medial midsole walls can define branch recesses 60LB and/or 60MB of the recess 60R. The lateral and medial cage elements 40L and 40M can be at least partially disposed in these branches of the recess. In some cases, where abrasion and wear is of concern, the branches 60LB and 60MB can be of a depth D3 that is equal to or greater than the thickness of the lateral and medial cage elements disposed in those recesses. In turn, this can at least partially protect the portion of the elements disposed within the branches of the recess.

Referring to FIG. 3, the midsole 52 can be further configured so that one or more securement projections 60P can extend upward and into the recess 60R. These securement projections can fit within one or more of the optional sole bridge openings 60O defined by the sole bridge 60. In this manner, the sole bridge 60 can be precisely positioned in the recess 60R. Further, with the securement projections extending into the respective openings, this can interlock and can provide mechanical securement of the sole bridge 60 in the recess 60R so that the sole bridge 60 does not slide laterally to the medial side M or the lateral side L, or vice versa.

Optionally, where the heel support recess 60RHS is included, the recess 60R can include a stop wall 60RS shown in FIG. 4. This stop wall 60RS can be located in the rearward part of the main portion of 60RM of the recess. The stop wall 60RS can be configured so as to engage the sole bridge rearward portion 61. With this configuration, when the heel support can be slightly tensioned, as the rearward part of the main portion 60RM engages the stop wall 60RS preventing the heel support from being pulled excessively.

Turning to the outsole 55 shown in FIGS. 4 and 5, the outsole 55 can be disposed below the midsole 52 and the upper 20. The outsole can include an outsole upper surface 55U. This outsole upper surface 55U can face toward and/or contact the midsole lower surface midsole 52L. The outsole upper surface 55U can be adhered, cemented and/or molded directly to the lower surface 52L in the regions where these elements contact one another so as to form the sole assembly 50. Further optionally, the sole bridge and its components can be adhered, cemented and/or molded to one or more portions of the sole assembly, in some cases, with the adhesive disposed in the recess with the sole bridge.

The outsole 55 can be constructed from one or more materials, such as rubber, and can include lugs, tread, or other gripping elements on the lower surface 55L thereof. Alternatively, the outsole 55 can be constructed from a thermoplastic polyurethane elastomer (TPU), nylon or other polymer blend that includes nylon and/or TPU. Of course, the outsole 55 can be constructed from any relatively wear resistant polymer, elastomer and/or natural or synthetic rubber or other materials capable of providing the desired functional characteristics. The outsole can be constructed to include thermoplastic elastomers and/or thermoset elastomers. Other materials, such as fiber-reinforced polymers, can be used. These can include epoxy, polyethylene, polyester, thermosetting plastic reinforced with carbon, glass and/or aramid fibers.

As illustrated in FIG. 5, and mentioned above, the outsole 55 optionally can define a portion of the recess 60R. As an example, the outsole can define a main outsole recess 55MP in the upper surface 55U that can be contiguous with the main portion 60RM of the midsole recess, with both recesses collectively forming the recess 60R. The outsole can further define one or more branches 55B contiguous with the main outsole recess 55MP, and corresponding to the branches of the recess 60R. The outsole 55 can include a heel support recess 55RHS that corresponds to the midsole heel support recess 60RHS. Each of the respective outsole recesses, when included, can house at least a portion of the respective side bridges, and/or heel support when included. Of course, all of the recess 60R that accommodates the sole bridge 60 can be defined by the midsole or the outsole in some constructions, in which case, the other of those two components might not define any recess within which the sole bridge and/or heel band is disposed.

Turning now to more details of the support cage 40, as shown in FIGS. 1, 6 and 7, that component can be constructed to include a medial cage element 40M and a lateral cage element 40L. These cage elements can be connected rearward, around the heel region 73, optionally by the heel band 46. Of course if desired, the heel band 46 can be absent from the construction, with the support cage 40 being primarily formed by the lateral 40L and medial 40M cage elements, joined with a sole bridge 60 extending through at least a portion of the sole assembly 50. Those lateral and medial cage elements as well as the heel band and a portion of optional heel support can all be disposed over the exterior of the upper. Further, each of the lateral cage elements, medial cage element, optional heel band and optional heel support can be partially or entirely free floating relative to the exterior of the upper. Of course, in some applications, the support cage 40 and its components can be minimally stitched to the upper in preselected locations depending on the function, with the support cage and its components still being considered substantially free floating relative to the upper.

The lateral and medial cage elements 40L and 40M respectively can include one or more elongated support elements 41, 42, 43 and 44, collectively forming a framework of support elements. The support elements can be separated from one another by one or more frame holes 41O. The frame holes can be entirely surrounded by the respective adjacent frame elements. Optionally, the frame holes are defined by the support cage and its components, for example the lateral and medial cage elements. With frame holes formed in this manner, the underlying upper 20 and, in particular, its exterior 20E, can be visible to a viewer of the footwear through the frame holes 41O.

As shown in FIG. 1, the lateral and medial cage elements 40L and 40M of the support cage can extend downward along the midsole exterior lateral 52L and exterior medial 52M walls respectively. To the lower portions of the lateral and medial cage elements 40L and 40M, the sole bridge 60 as mentioned above can be joined. Those components can form an integral, continuous, single piece, monolithic unitary structure, as illustrated in FIG. 8.

The sole bridge 60 as mentioned above can extend across the width W of the sole assembly 50. This component also can extend through the recess 60R as defined by the sole assembly. Optionally, the sole bridge can be fixedly attached via cement and/or fasteners to at least one of the midsole and/or outsole, or physically entrapped by at least one of the midsole and outsole, so that the sole bridge is non-removable from the footwear without deforming, tearing and/or destroying the footwear or the cage. As explained above, the sole bridge can be captured in the recess, located adjacent the lower surface and/or located adjacent and generally above the outsole, with at least part of the outsole concealing the bottom of sole bridge when a viewer views the bottom of the footwear. In some cases, no part of the bottom of the sole bridge is exposed on the underside of the footwear, because the outsole can completely conceal it there, generally extending over the sole bridge from front to back of the sole bridge. Further optionally, the sole bridge can include a framework of elongated members 60M that intersect one another at a plurality of corresponding intersections 60I. These elongated members 60M can form therebetween the sole bridge openings 60O defined by the sole bridge, within which the sole projections 60P can extend.

The sole bridge 60 can include sole bridge bands 64 and 65 that are joined with a central portion 60C of the sole bridge 60. The central portion can extend between the sole bands 64 and 65, generally along the longitudinal axis LA. The sole bridge bands 64 and 65 can be joined with the lower portions of the lateral and medial cage elements 40L and 40M. Optionally, the central portion 60C is not joined directly to the lateral and medial cage elements 40L and 40M. Further, the central portion can be inset relative to the exterior midsole walls 52L and 52M. In some cases, the central portion can be concealed within the sole assembly, for example, the midsole and in particular the recess 60 R. The sole bridge bands can extend upwardly to the lateral and medial cage elements, but the central portion 60 C might not extend to those cage elements.

As explained above with reference to FIGS. 3 and 8, the support cage 40 can include a heel support 48. This heel support 48 can extend rearward from the sole bridge 60. In particular, the heel support can include a forward portion 48F joined a sole bridge and optionally the rearward sole bridge band. The heel support 48 can extend rearward, generally parallel to and/or aligned with the longitudinal axis LA, and under the heel H of the wearer. The heel support 48 can include a rearward portion 48R. This rearward portion 48R can transition upwardly from the main portion of the heel support 48 that extends under the heel H toward the heel band 46. The rearward portion 48R can extend to and can be integrally joined with the heel band 46, rearward of the heel H of the wearer. If desired, this heel support 48 can be absent from the construction.

As shown in FIGS. 1, 4 and 7, the support cage 40 optionally can include the heel counter band 46 adjacent the heel section 20H. The heel band can extend around at least a portion of the wearer's heel and can be in the form of an elongated element or strip. The band can extend rearward from the lateral cage element 40L. Optionally, the heel band extends around the rear of the heel H, and back toward the medial cage element 40M, to which it is joined. Indeed, the heel band 46 can be integrally formed and monolithic with the lateral and medial cage elements, which collectively form a unitary, one-piece support cage, for example as illustrated in FIG. 8. These components can be constructed to cooperatively to provide stability and structural support around and to the heel of a wearer. The support cage 40, the heel band 46 and/or heel support 48 can cooperate with the heel cup 57 of the midsole 52 to provide additional stability, centering and support for the heel H of a wearer.

Optionally, the sole bridge 60 can be constructed so as to form a shank and/or protective plate under the foot of the wearer. This protective plate can have a thickness of optionally at least 2 mm, further optionally at least 5 mm, and even further optionally at least 10 mm. When the sole bridge forms a protective plate, it can span forwardly through the arch region 72 of the footwear and toward a forefoot region 71 of the footwear 10. In some cases, the protective plate can extend forwardly within the recess 60R and into the forefoot region 71. Further optionally, the protective plate can extend substantially through the forefoot region 71, generally to the forward portion of the footwear as illustrated in broken lines in FIG. 3.

The components of the support cage 40 mentioned above can be integrally joined with one another, formed as a unitary, monolithic structure constructed from a polymeric material that is semi-rigid but flexible. Optionally, the support cage can be constructed from thermoplastic polyurethane elastomer, other thermoplastic elastomers, thermoset elastomers, polyvinyl materials, nylon, high or low density polyethylene or any other relatively wear resistant polymer, elastomer and/or natural or synthetic rubber or other materials capable of rendering the support cage generally semi-rigid but flexible. Other materials, such as fiber-reinforced polymers, can be used. These can include epoxy, polyethylene, polyester, thermosetting plastic reinforced with carbon, glass and/or aramid fibers. Optionally, the support cage 83 can be translucent and/or transparent.

As shown in FIGS. 1, 5 and 7, the upper 20 can fit into the upper cavity UC defined by the support cage 40, the midsole 52, and generally the sole assembly 50. The upper 20 can be adhered, cemented, fastened and/or stitched to the upper surface 52U of the midsole, but left free floating relative to the components of the support cage 40.

As shown in FIGS. 1 and 7, the upper 20 can include multiple panels 31, 32 and 33 that are joined together to form a generally continuous arch across the top of the wearer's foot, optionally above the tops of the metatarsals, in the arch region 72 of the footwear. Collectively, these panels can form an upper midfoot section 34 located between the forefoot region 71 and the heel region 73, optionally over the arch region 72.

The panels 31, 32 and 33 can be formed to impart different characteristics to each of them and thus the upper. For example, the medial panel 31 and lateral 32 can be constructed from a generally elastic and stretchable material such as Lycra or Spandex. The panels exterior 31E and 32E, and the exterior 20E in general, can be constructed from a mesh material formed from a nylon or other braided material, and can be generally slippery or low friction. This can enable the interior surface 40I of the support cage 40 to move freely and float relative to the exterior of the panels and the exterior 20E of the upper in general. Optionally, portions of the medial panel and lateral panel can be visible through the lateral and medial cage elements in particular the framework of those elements defining frame holes.

The central panel 33 can be contiguous with the lateral and medial upper panels 31 and 32 and constructed from the same or similar materials. Optionally, this panel 33 can be separate from the lateral and medial panels, forming a tongue over the wearer's instep. The central panel can be less stretchable and/or pliable than the respective side panels. The central panel also can include more cushioning in the form of additional foam or other material disposed therein. This cushioning can alleviate any extra stresses exerted across the top of the wearer's foot when a lace system 39 is installed and extends over the central panel 33 of the midfoot section 34 to secure the lateral and medial cage elements to one another, generally over the upper.

As illustrated in FIGS. 1, 5 and 7, the upper 20 can include a lower peripheral allowance 25. This lower peripheral allowance 25 can be Strobel stitched to an insole board or Strobel board 23 in the final construction. The upper 20 also can include a toe section 20T and a heel section 20H that are joined via the midfoot section of the upper. The toe section 20T can cover the toes and the forward portions of the phalanges of the wearer's foot. The toe section 20T can include a bumper to prevent tearing or scuffing of the material from which the toe section 60 is constructed. The toe section can be coextensive with the lateral 31 and medial 32 side panels as well as the central panel 33.

Optionally, the heel section 20H can include additional cushioning and/or padding to pad the region of the footwear in the heel that repeatedly and forcibly engages the back of the heel of the wearer. Additional liners or other material can be disposed on the interior of the footwear in the heel section, depending on the particular application.

As mentioned above, the support cage 40 can be separately constructed from the upper 20, and optionally not attached to the upper, with a small space formed therebetween when the footwear is not on a wearer's foot. The upper 20 can be disposed under at least a portion of the support cage 40. Optionally, the support cage 40 can be pulled away from the upper 20 when the lacing system 39 is loosened or removed from the footwear 10. In particular, the lateral and medial cage elements 41 and 42 for example can be pulled outward and away from the side panels 31 and 32, respectively. Again, with this free floating, detached construction between the support cage and the upper, the foot can be comfortably placed within the footwear, while the upper can move dynamically relative to the support cage to accommodate different foot sizes and shapes, as well as accommodate the changing shape of a foot during a dynamic activity such as a natural gait cycle. Generally, the support cage is free floating relative to the midfoot section and/or upper 20 so that an interior surface 40I of the support cage can engage or move relative to an exterior layer or surface 20E of a upper medial panel and/or lateral panel so that footwear can accommodate multiple foot shapes therein.

Optionally, the support cage 40 can include one or more lace attachment elements 49 adapted for use with the lacing system 39. These lace attachment elements 49 can be disposed at the upper portions of the lateral and medial cage elements. The lace elements can be in the form of grommets, rings or holes disposed or defined by the upright elements or attached to the upright elements depending on the particular application. The lace attachment elements can interface with the lacing system to keep the footwear on the wearer's feet and to complete the construction connecting the lateral and medial sides of the support cage to provide the desired structural support.

A method of making the footwear 10 will now be described with further reference to FIGS. 1-8. To construct the footwear 10, the sole assembly 50 can be molded in a mold. As an example, midsole 52 and the outsole 55 can be separately molded in respective first and second molds, each including portions of the respective sole bridge recess as desired. The support cage 40, with all of its components, for example the lateral and medial cage elements, sole bridge and optional heel band and optional heel support, also can be molded in a mold, separate and distinct from the sole assembly mold.

The upper 20 can be assembled, optionally on a last. The various panels can be connected and stitched or otherwise fastened to one another. The insole board and/or Strobel board 23 can be joined with the remainder of the upper.

The support cage 40 can be joined with the sole assembly 50. Optionally, the sole bridge 60 can be disposed in the sole recess 60R defined by the midsole 52. Where included, the heel support can be disposed in a corresponding heel recess in the midsole. Where included, the projections of the midsole can be aligned with the openings in the sole bridge to provide a mechanical interlock between these elements. Optionally, the sole bridge can be adhered cemented or otherwise fastened within the recess.

The outsole 55 disposed over the sole bridge and the optional heel support. The outsole upper surface 55U can be adhered, cemented an overmolded to the lower surface 52L of the midsole, thereby further trapping the sole bridge and optional heel support in the recess. The components of the sole assembly effectively joined with the support cage 40, the upper cavity UC as shown in FIG. 6 is formed.

The upper 20, being fully formed, be placed within the upper cavity UC. Generally, the Strobel board 23 engages and contacts the upper surface 52U of midsole 52. Here, the Strobel board 23 can be cemented or adhered to that upper surface. The support cage and its components extend upwardly along the lateral and medial sides of the upper. Where included, the heel band extends around the heel portion 20H of the upper. Generally, the support cage wraps around the upper, starting at the lateral and medial panels of the upper around the heel portion of the upper. Again, the support cage and its components can be free floating relative to the exterior 20E of the upper 20.

After the sole assembly, support cage and upper are joined, the footwear can undergo additional finishing operations to brush, cleanup and touchup the footwear for further packing or distribution.

Figure 9:
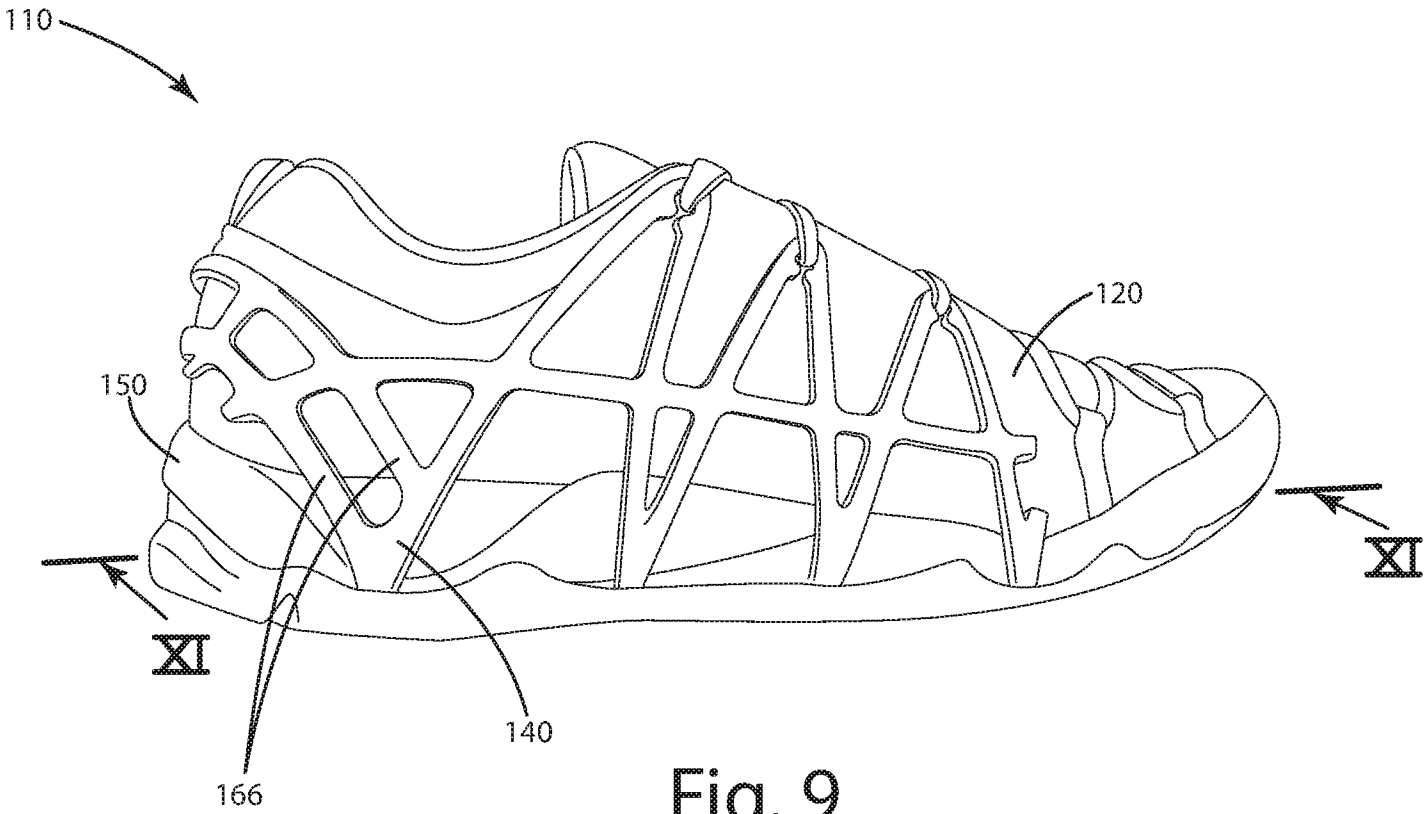
FIG. 9 is a perspective view of a first alternative embodiment of the footwear including a support cage.
Figure 10:
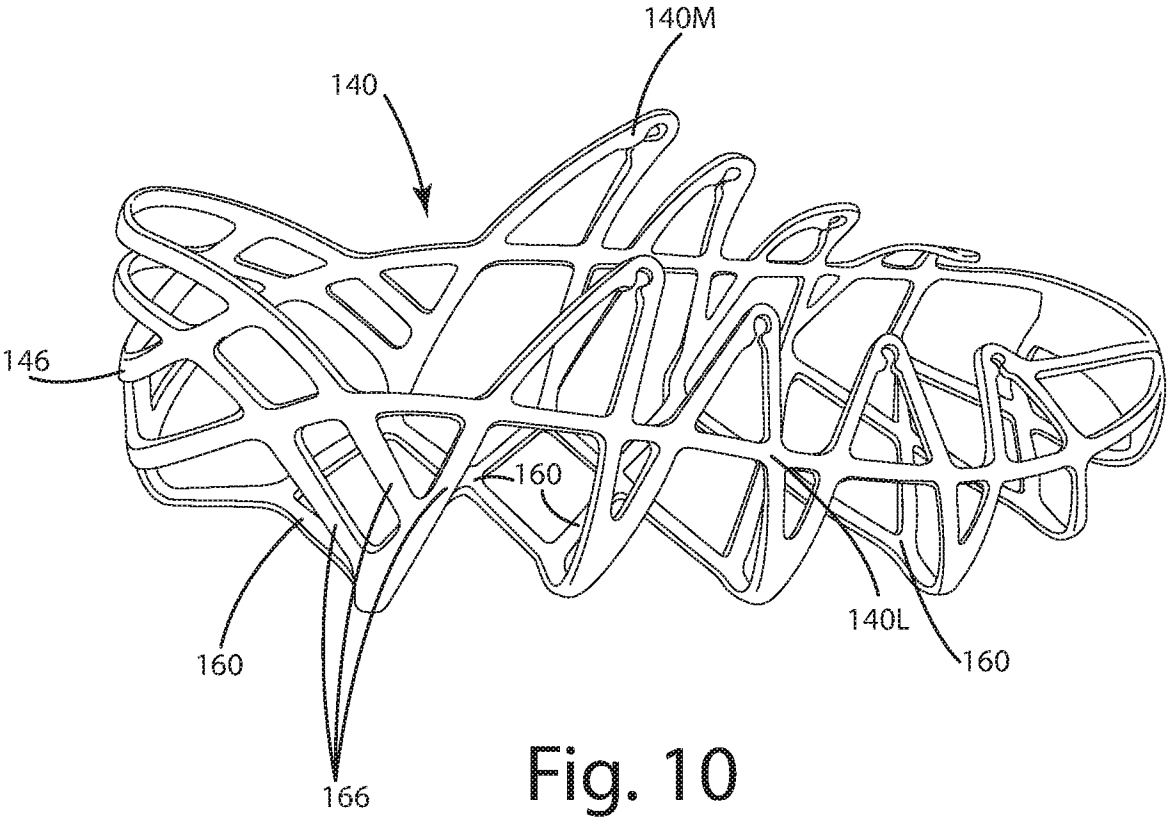
FIG. 10 is a perspective view of the support cage of the first alternative embodiment.
Figure 11:
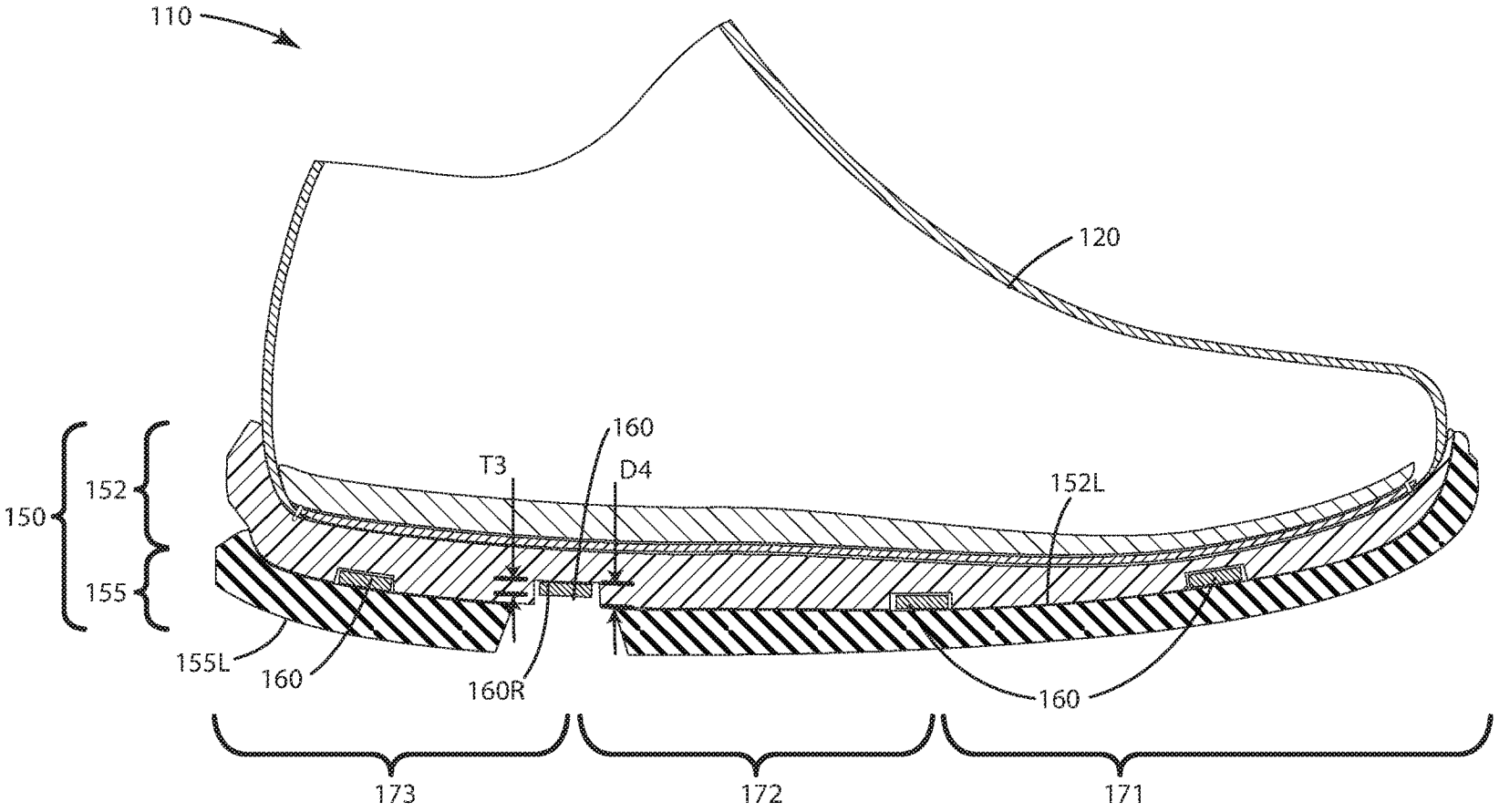
FIG. 11 is a section view of the footwear taken along lines 11-11 of FIG. 9.

A first alternative embodiment of the footwear is shown in FIGS. 9-11 and generally designated 110. This embodiment can be similar to the embodiment described above in structure, function and purpose. For example, in this footwear 110, the upper 120 is free floating relative to the semi-rigid but flexible support cage 140. The support cage 140, however, can be constructed somewhat differently. The support cage can include a sole bridge 160 that extends across the width of the footwear, generally from a lateral side of the footwear to a medial side of the footwear in multiple locations within the forefoot region 171, the arch region 172, and the heel region 173 of the footwear 110. Further optionally, the portion of the sole bridge extending across the sole assembly in the heel region 173 can be joined with lateral and medial support cage heel elements 166 that extend upwardly and form a portion of a heel band 146 of the support cage.

In this embodiment, as shown in FIGS. 9 and 11, the support cage 140, and in particular the sole bridge 160, can extend through recesses 160R defined by the sole assembly 150. The recesses 160R, however, can be defined on only the lower surface 152L of the midsole 155. Accordingly, the sole bridge is entirely concealed in the midsole, being unviewable to a viewer there. The recesses 160R can be of a depth D4 that is greater than the thickness T3 of the sole bridge in that region. Of course, in some cases, the thickness T3 of the sole bridge can be equal to or greater than the depth D4 of the recesses.

Figure 12:
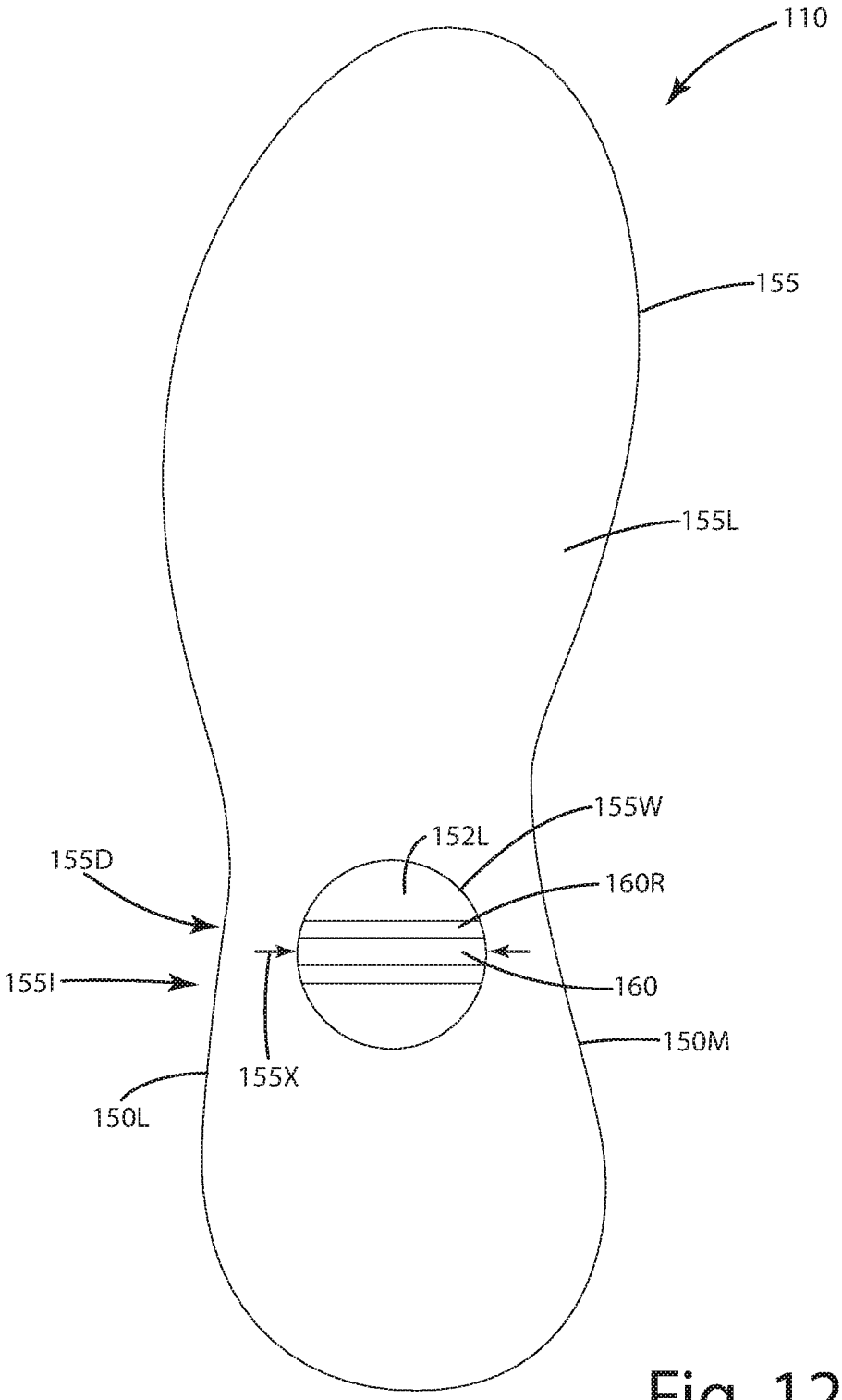
FIG. 12 is a bottom view of the footwear of the first alternative embodiment.

Optionally, in this embodiment, the support cage 140 can extend forward of the arch region 172, and in some cases can surround the upper 120 in the forefoot region 171 as well. Further optionally, as shown in FIGS. 11 and 12, this embodiment can include a viewing window 150W through which the support bridge 160 can be viewed. For example, the sole assembly 150, and the outsole 155 in particular can define a window 150W that extends through the outsole, adjacent one or more sections of the sole bridge 160. In this manner, a user can view that the support cage, and in particular, its sole bridge 160, extending under the midsole, through the sole assembly, to provide the stability and enhanced performance.

As shown in FIG. 12, the sole bridge 160 and the recess 160R, as well as the lower surface 152L can be visible through the window 150W. The window can be sized so that it does or does not extend to the lateral and medial sides 150L and 150M of the outsole. For example, the window can be inset a distance 1501 from those sides. The window also can be of a width 155X that is less than the width 155D of the outsole and or midsole in the region where it is disposed. If desired, the window width 155X can be optionally less than 80%, further optionally less than 70%, even further optionally less than 50% and/or yet further optionally less than 25% of the outsole width 155D. In some cases, this can enable the outsole to retain its structural integrity in the area where the window is disposed, yet still enable a viewer to confirm that the sole bridge is in the construction.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an outsole;

a midsole joined with the outsole and disposed above the outsole, at least one of the outsole and the midsole defining a recess that extends laterally across a longitudinal axis of the footwear, from a medial side of the footwear to a lateral side of the footwear;

an upper having an exterior and including a midfoot section including a lateral panel disposed on the lateral side of the footwear and a medial panel disposed on the medial side of the footwear, the upper joined with at least one of the outsole and the midsole; and a semi-rigid and flexible support cage constructed as a unitary, solid one piece polymeric unit, the support cage including a lateral element and a medial element disposed on opposite sides of the longitudinal axis, the support cage wrapping over at least a portion of the exterior of the upper, the support cage including a framework of a plurality of support elements separated from one another by frame holes that enable a viewer to view the underlying exterior of the upper, wherein the support cage is free floating relative to the exterior of the upper so that the support cage is configured to engage but move relative to the lateral and medial panels, wherein the support cage includes a sole bridge that is disposed within and extends through the recess defined by the midsole, the sole bridge spanning across a width of the footwear from the lateral side to the medial side, transverse to the longitudinal axis, the sole bridge element structurally joining the lateral element and the medial element of the support cage, wherein the support cage includes a lateral cage element disposed on the lateral side of the longitudinal axis and a medial cage element disposed on the medial side of the longitudinal axis, wherein the support cage includes a heel band that is integral with the lateral cage element and that extends rearward from the lateral cage element, and around a heel the footwear, and back toward the medial cage element with which the heel band is integrally joined, wherein the support cage includes a lower heel support having a forward portion that is joined with the sole bridge, wherein the lower heel support extends rearwardly from the sole bridge, and is adapted to extend under a heel of the wearer to a rearward portion, wherein the rearward portion transitions to an upward portion that extends upwardly to the heel band, wherein the upward portion is joined with the heel band and is adapted to extend rearward of the heel of the wearer, whereby the footwear can adaptively fit a plurality of foot shapes and provide support to the foot of the wearer.

2. The article of footwear of claim 1, wherein the plurality of support elements span across the exterior of the upper and are joined with one another at a plurality of respective intersections.

3. The article of footwear of claim 1, wherein the sole bridge forms a protective plate having a thickness of at least 2 mm, wherein the protective plate spans forwardly through an arch region of the footwear and toward a forefoot region of the footwear.

4. The article of footwear of claim 3, wherein the protective plate defines a plurality of openings, wherein the openings are located within the recess.

5. The article of footwear of claim 1, wherein the midsole includes a midsole exterior lateral side and a midsole exterior medial side, wherein the support cage extends downward beside the midsole exterior lateral side and the midsole exterior medial side, on the respective lateral and medial sides.

6. An article of footwear comprising:

an upper having an exterior;

a support cage constructed from a semi-rigid but flexible polymer, the support cage being disposed over at least a portion of the exterior of the upper and being free floating relative to the at least a portion of the exterior of the upper, the support cage including a sole bridge that extends transverse to a longitudinal axis of the footwear, from a medial side of the footwear to a lateral side of the footwear;

a midsole joined with the support cage, the midsole being disposed above the sole bridge;

an outsole joined with the midsole, the outsole being disposed below the sole bridge;

a heel band that is integrally formed as a unitary piece with the support cage, the heel band adapted to extend rearward and around a heel the footwear; and a lower heel support having a forward portion that is joined with the sole bridge, wherein the midsole includes a midsole exterior lateral side and a midsole exterior medial side, wherein the support cage extends downward beside the midsole exterior lateral side and downward beside the midsole exterior medial side on the respective lateral and medial sides, wherein the lower heel support extends rearwardly from the sole bridge, and is adapted to extend under a heel of the wearer to a rearward portion, wherein the lower heel support is in the form of an elongated strip, disposed substantially inward from the lateral and medial sides of the footwear, wherein the rearward portion transitions to an upward portion that extends upwardly to the heel band, wherein the upward portion is integrally joined with the heel band and is adapted to extend rearward of the heel of the wearer.

7. The article of footwear of claim 6, wherein at least one of the outsole and the midsole define a recess extending transverse to a longitudinal axis of the footwear, from a medial side of the footwear to a lateral side of the footwear, wherein the sole bridge is disposed in and extends through the recess.

8. The article of footwear of claim 7, wherein the sole bridge extends through a substantial portion of an arch region of the footwear, forming an underfoot protective plate having a thickness of at least 2 mm.

9. The article of footwear of claim 8, wherein the underfoot protective plate extends forward through a substantial portion of a forefoot region of the footwear.

10. The article of footwear of claim 6, wherein the support cage includes a lateral cage element disposed on the lateral side of the longitudinal axis and a medial cage element disposed on the medial side of the longitudinal axis, wherein the heel band is integral with the lateral cage element and the medial cage element, wherein the lateral cage element, medial cage element and heel band are all entirely free floating over the exterior of the upper, whereby the support cage freely moves relative to the upper.

11. The article of footwear of claim 6, wherein at least one of the midsole and the outsole define a recess that extends transverse to the longitudinal axis from the medial side of the footwear to the lateral side of the footwear, wherein the sole bridge is disposed in the recess.

12. The article of footwear of claim 11, wherein the sole bridge includes a framework of sole bridge elements separated from one another so as to form a plurality of sole bridge openings under the midsole.

13. An article of footwear comprising:

an upper having an exterior;

a support cage constructed from a semi-rigid but flexible polymer, the support cage being disposed over at least a portion of the exterior of the upper and being free floating relative to the at least a portion of the exterior of the upper, the support cage including a sole bridge that extends transverse to a longitudinal axis of the footwear, from a medial side of the footwear to a lateral side of the footwear;

a midsole joined with the support cage, the midsole being disposed above the sole bridge;

an outsole joined with the midsole, the outsole being disposed below the sole bridge;

a heel band that is integral with the support cage, the heel band adapted to extend rearward and around a heel the footwear; and a lower heel support joined with the sole bridge and adapted to extend rearward from the sole bridge, under a heel of the wearer, wherein the midsole includes a midsole exterior lateral side and a midsole exterior medial side, wherein the support cage extends downward beside the midsole exterior lateral side and downward beside the midsole exterior medial side on the respective lateral and medial sides, wherein the heel support transitions upwardly to and is integrally joined with the heel band and adapted to extend adjacent the heel of the wearer, wherein at least one of the midsole and the outsole define a recess that extends transverse to the longitudinal axis from the medial side of the footwear to the lateral side of the footwear, wherein the sole bridge is disposed in the recess.

14. The article of footwear of claim 13, wherein the support cage includes a framework of support elements separated from one another by frame holes that enable a viewer to view the underlying exterior of the upper.

15. The article of footwear of claim 6, wherein the midsole includes a midsole lower surface that defines a recess, wherein the outsole includes an outsole upper surface secured to the midsole lower surface, wherein the recess is formed above the outsole upper surface, wherein the sole bridge extends through the recess, across a width of the footwear.

16. The article of footwear of claim 15, wherein the sole bridge forms an underfoot protective plate, wherein the sole bridge extends within an arch region and a forefoot region of the footwear.

17. An article of footwear comprising:

a longitudinal axis;

a lateral side disposed opposite a medial side across a longitudinal axis;

a sole assembly including a heel region, an arch region and a forefoot region, the sole assembly defining an recess extending across a width of the sole assembly from the medial side to the lateral side;

an upper joined with the sole assembly, the upper including an exterior;

a support cage constructed from a semi-rigid but flexible polymeric material, the support cage extending on the medial side and the lateral side, the support cage being disposed over the exterior of the upper and being free floating relative to the exterior of the upper so that an interior of the support cage can engage but move relative to the exterior of the upper, the support cage including a sole bridge that extends transverse to a longitudinal axis of the footwear, from the medial side to the lateral side of the footwear, and through the recess defined by the sole assembly;

a heel band that is integrally formed as a unitary piece with the support cage, the heel band adapted to extend rearward and around a heel the footwear; and a lower heel support having a forward portion that is joined with the sole bridge, wherein the lower heel support extends rearwardly from the sole bridge, and is adapted to extend under a heel of the wearer to a rearward portion, wherein the lower heel support is in the form of an elongated strip, disposed substantially inward from the lateral and medial sides of the footwear, wherein the rearward portion transitions to an upward portion that extends upwardly to the heel band, wherein the upward portion is integrally joined with the heel band and is adapted to extend rearward of the heel of the wearer, whereby the footwear can adaptively fit a plurality of foot shapes therein and is adapted to provide stability to the foot of the wearer.

* * * * *